US010119781B1

(12) United States Patent
Teetzel et al.

(10) Patent No.: US 10,119,781 B1
(45) Date of Patent: Nov. 6, 2018

(54) GRENADE LAUNCHER AND PIVOT MECHANISM FOR SAME

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/973,023

(22) Filed: May 7, 2018

Related U.S. Application Data

(60) Provisional application No. 62/502,912, filed on May 8, 2017.

(51) Int. Cl.
*F41C 27/06* (2006.01)
*F41A 35/06* (2006.01)
*F41G 11/00* (2006.01)

(52) U.S. Cl.
CPC ..... *F41C 27/06* (2013.01); *F41A 35/06* (2013.01); *F41G 11/003* (2013.01)

(58) Field of Classification Search
CPC ..... F41C 27/06; F41A 35/06; F41F 1/00
See application file for complete search history.

(56) References Cited

U.S. PATENT DOCUMENTS 3,279,114 A 10/1966 Lewis et al.
3,332,162 A 7/1967 Martwick et al.
3,365,828 A 1/1968 Badali et al.
3,442,173 A 5/1969 Muller
3,507,067 A 4/1970 Into
3,557,482 A * 1/1971 Hoover ..... F41C 27/06 42/1.07

(Continued)

FOREIGN PATENT DOCUMENTS

WO 2016089863 A2 6/2016

OTHER PUBLICATIONS

"Glock Super Tactical Body Dropper" (Handgun Holsters and Guns) (online) (retrieved from the Internet on Sep. 3, 2016) <URL https://brokenlizard.wordpress.com/2010/10/15/glock-super-tactical-body-dropper/>, Oct. 15, 2010.

*Primary Examiner* — Benjamin P Lee
(74) *Attorney, Agent, or Firm* — McLane Middleton, Professional Association

(57) ABSTRACT

A grenade launcher is provided comprising a chassis, a barrel assembly, and a pivot mechanism. The pivot mechanism comprises a first pivot bar on the barrel assembly extending transversely. The first pivot bar has a first hinge barrel disposed at one transverse end thereof and is attachable in a first orientation wherein the first hinge barrel is on a left side of the barrel assembly and a second orientation wherein the first hinge barrel is on a right side of the barrel assembly. A second pivot bar is disposed on the chassis and has a second hinge barrel disposed at one transverse end thereof. The second pivot bar is attachable in a first orientation wherein the second hinge barrel is on a left side of the barrel assembly and a second orientation wherein the second hinge barrel is on a right side of the barrel assembly. A pivot pin extends in vertical openings in the first and second hinge barrels and defines a pivot axis for pivoting movement of the barrel assembly between a closed position and either a left or a right open position.

18 Claims, 13 Drawing Sheets

(56) References Cited

U.S. PATENT DOCUMENTS 3,641,691 A 2/1972 Ellis et al.
3,967,402 A 7/1976 Cooksey
3,967,403 A 7/1976 Reynolds
4,019,424 A 4/1977 Reynolds
4,603,498 A 8/1986 Johnson
4,689,911 A 9/1987 White
4,733,489 A 3/1988 Kurak
5,052,144 A 10/1991 Ostor
5,146,705 A 9/1992 Martin
5,198,600 A 3/1993 E'Nama
5,235,771 A 8/1993 Sokol et al.
5,591,932 A 1/1997 Staiert et al.
5,669,174 A 9/1997 Teetzei
5,689,908 A 11/1997 Brandl
5,930,935 A 8/1999 Griffin
6,142,058 A 11/2000 Mayville et al.
6,250,194 B1 6/2001 Brandt et al.
6,453,594 B1 9/2002 Griffin
6,481,145 B2 11/2002 Weichert et al.
6,752,137 B2 6/2004 Brunette et al.
6,829,858 B2 12/2004 Gablowski
D517,637 S 3/2006 Murello et al.
7,010,879 B2 3/2006 Olson
7,021,187 B1 4/2006 Grassi
7,143,539 B2 12/2006 Cerovic et al.
7,269,920 B2 9/2007 Staley, III
7,328,530 B2 2/2008 Griffin
7,360,478 B2 * 4/2008 Compton ..... F41A 35/06 42/105
7,409,912 B2 8/2008 Cerovic et al.
7,458,179 B2 12/2008 Swan
7,487,612 B2 2/2009 Macaluso
7,661,348 B2 * 2/2010 Murello ..... F41A 11/02 89/6
7,891,130 B2 2/2011 Griffin
7,966,763 B1 6/2011 Schneider et al.
8,020,334 B2 9/2011 Delmonico
8,141,289 B2 3/2012 Gomez et al.
8,191,300 B2 6/2012 Daniel
8,209,897 B2 7/2012 Schneider et al.
8,296,985 B2 * 10/2012 Krutil ..... F41A 3/58 42/105
8,393,107 B2 3/2013 Brown
8,459,996 B2 6/2013 Sullivan
8,549,783 B2 10/2013 Marquez
8,991,091 B2 3/2015 Griffin
9,021,733 B1 5/2015 DiChario
9,228,801 B2 1/2016 Hosz
9,618,299 B1 4/2017 Gingrich
2001/0042334 A1 11/2001 Weichert et al.
2004/0025395 A1 2/2004 Gablowski
2005/0132628 A1 6/2005 Olson
2005/0188593 A1 9/2005 Cerovic et al.
2006/0026884 A1 2/2006 Cerovic et al.
2006/0026885 A1 2/2006 Tony
2006/0201044 A1 9/2006 Griffin
2006/0272193 A1 12/2006 Zedrosser
2007/0068057 A1 * 3/2007 Macaluso ..... F41C 7/025 42/105
2007/0074437 A1 * 4/2007 Compton ..... F41A 35/06 42/12
2008/0216378 A1 9/2008 Murello
2009/0178325 A1 7/2009 Veilleux
2009/0277069 A1 11/2009 Delmonico
2010/0192439 A1 8/2010 Murello
2011/0010981 A1 1/2011 Wieland
2011/0016765 A1 1/2011 Griffin
2011/0131857 A1 6/2011 Kuczynko et al.
2012/0144712 A1 6/2012 Rostocil
2012/0151813 A1 6/2012 Brown
2012/0297970 A1 11/2012 Langevin et al.
2014/0190061 A1 7/2014 Griffin
2014/0237883 A1 8/2014 Hosz
2015/0007477 A1 1/2015 Langevin et al.
2015/0107143 A1 4/2015 Coetzee et al.
2015/0135576 A1 5/2015 Wells et al.
2016/0153744 A1 6/2016 Teetzel et al.

* cited by examiner

GRENADE LAUNCHER AND PIVOT MECHANISM FOR SAME

CROSS REFERENCE TO RELATED APPLICATIONS

This application claims the priority benefit of U.S. provisional application No. 62/502,912 filed May 8, 2017. This application is also related to U.S. Provisional Application No. 62/085,967 filed Dec. 1, 2014 and U.S. Nonprovisional application Ser. No. 14/955,363 filed Dec. 1, 2015. Each of the aforementioned applications is incorporated herein by reference in its entirety.

BACKGROUND

The present development relates to grenade launchers and, more particularly, to an improved pivot mechanism for a grenade launcher barrel which can be configured to accommodate left- or right-handed shooters. Although the present development will be illustrated herein in reference to a grenade launcher attached to a rifle, it will be recognized that the present development is equally amenable to a standalone grenade launcher.

SUMMARY

In one aspect, a grenade launcher assembly as may be operable as a standalone grenade launcher or as attachable to a firearm include a pivot mechanism, capable of configuring the grenade launcher assembly for a right handed shooter or a left handed shooter. When it is desired to configure the grenade launcher assembly for a right handed shooter, actuating a barrel/breech lock release causes the barrel assembly to pivot to the left side of the firearm. When it is desired to configure the grenade launcher assembly for a left handed shooter, actuating the barrel/breech lock release causes the barrel assembly to pivot to the right side of the firearm.

BRIEF DESCRIPTION OF THE DRAWING

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
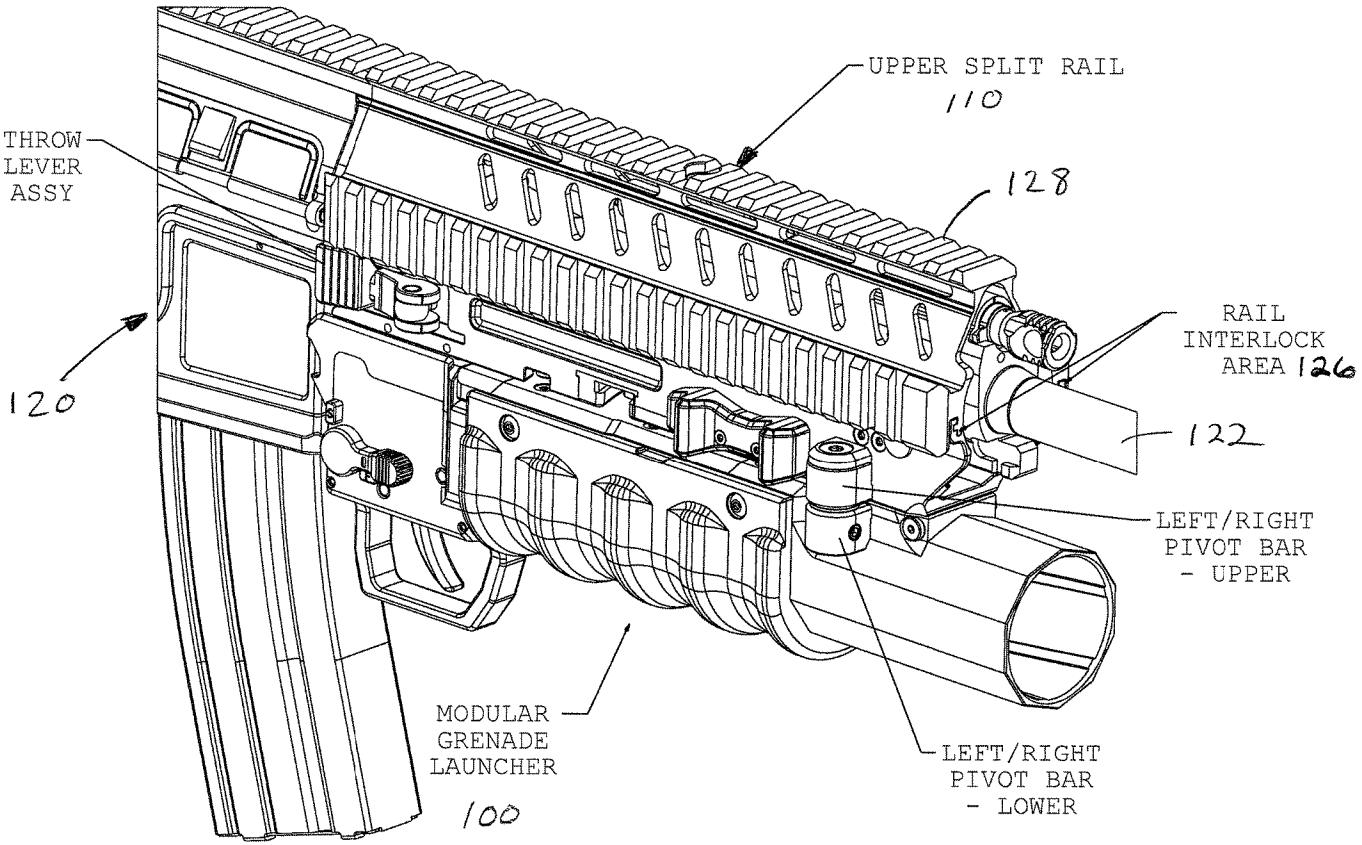
FIG. 1 is a fragmentary, isometric view of a firearm having a grenade launcher system according to an exemplary embodiment of the present invention.
Figure 2:
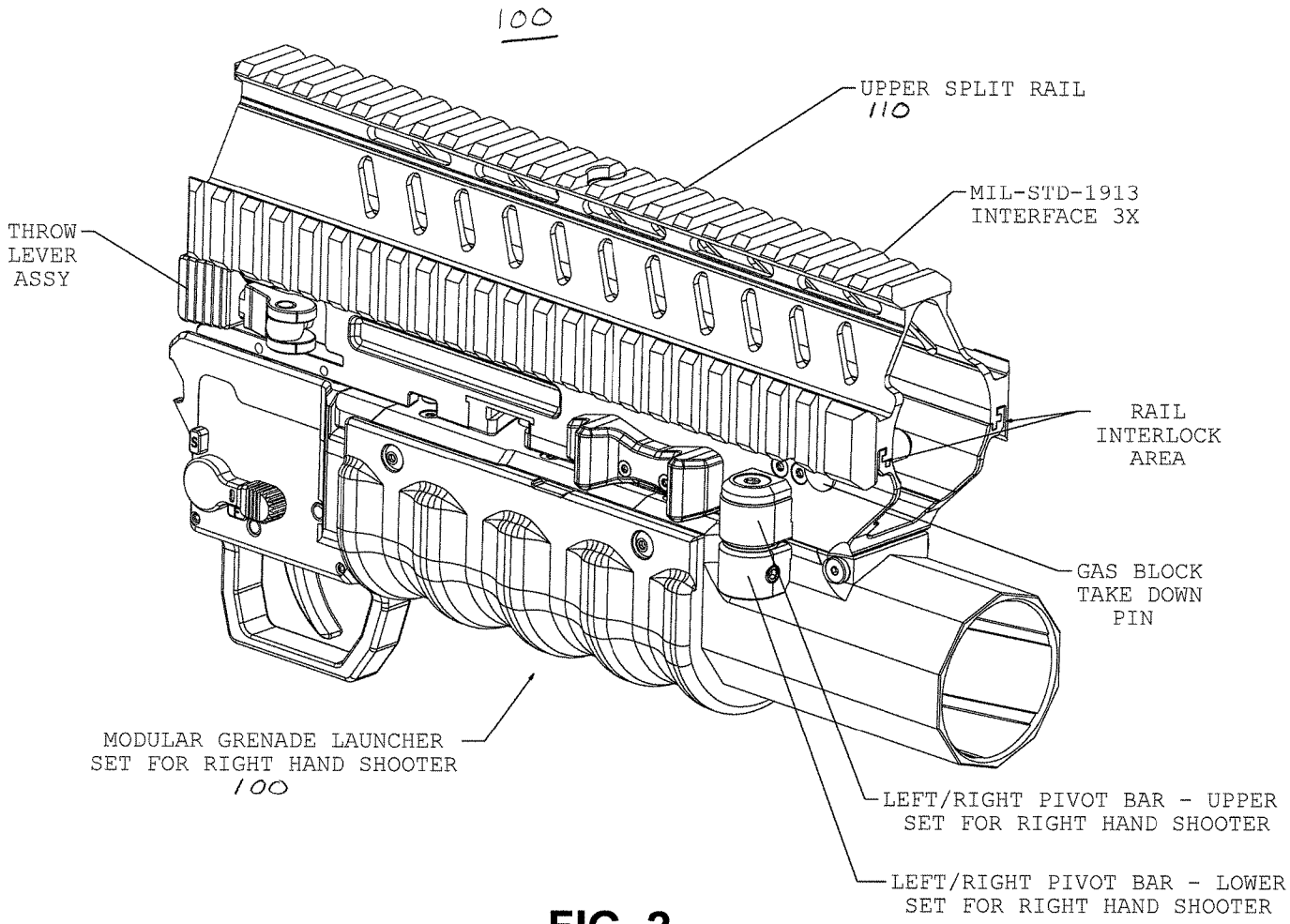
FIG. 2 is an isometric view of the grenade launcher system appearing in FIG. 1, with the firearm removed.
Figure 3:
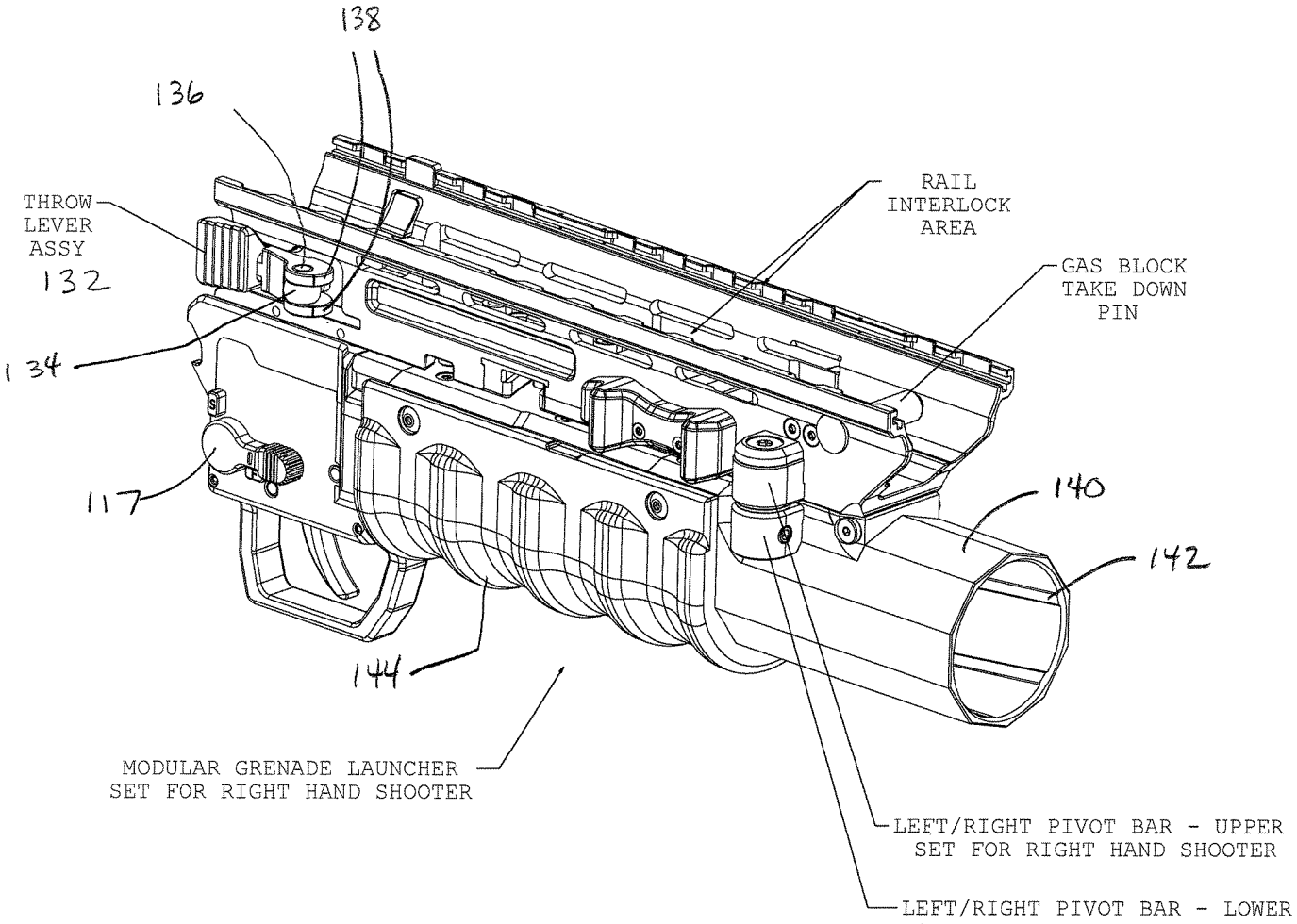
FIG. 3 is an isometric view of the grenade launcher system appearing in FIG. 2, with the upper rail housing removed.
Figure 4:
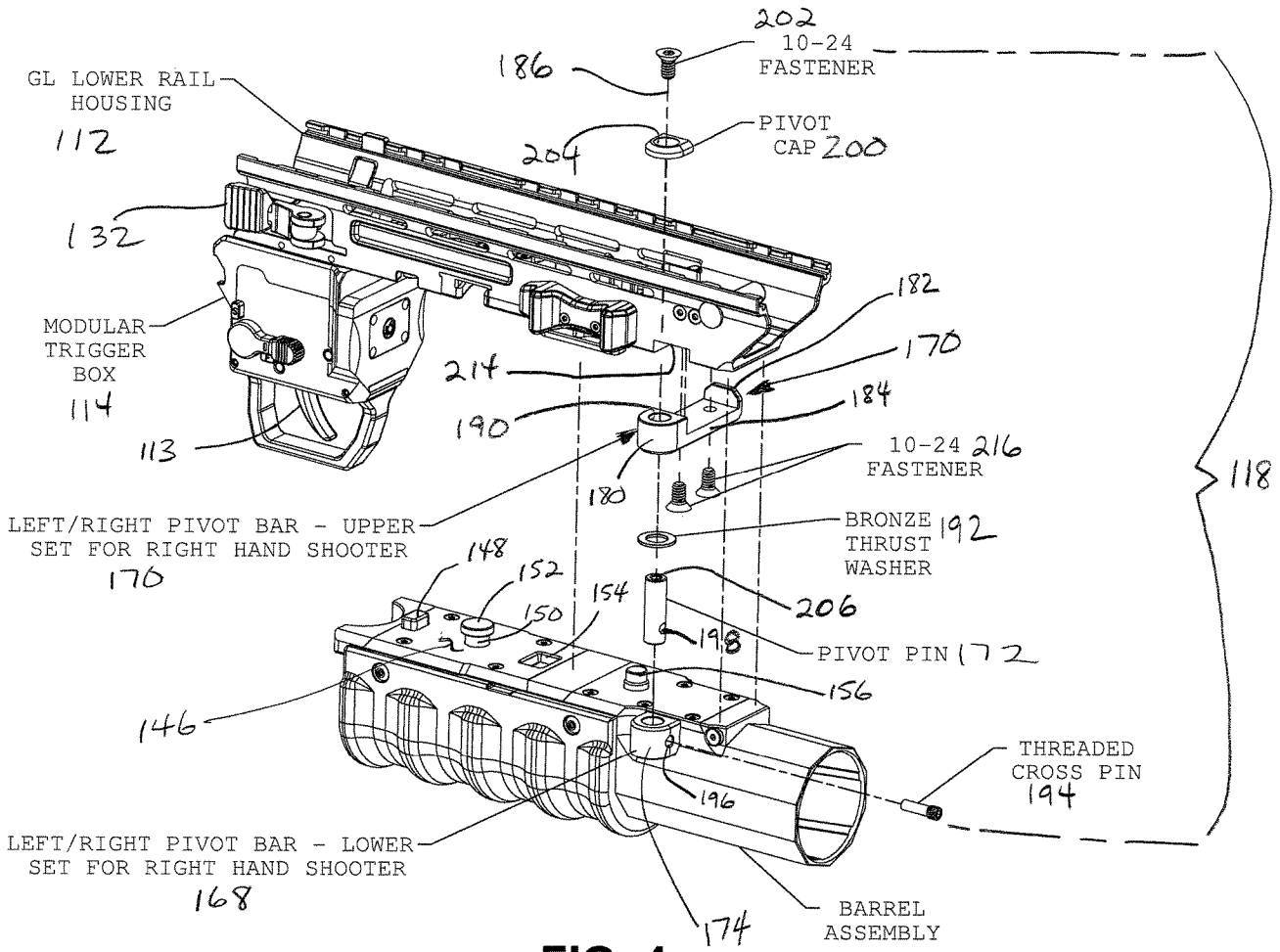
FIG. 4 is a partially exploded, isometric view of the grenade launcher system appearing in FIG. 3, taken generally from above.

Unless indicated otherwise, positional and directional references used herein, such as "above," "horizontal," "left," "right," and the like, are in reference to a rifle with an attachable grenade launcher that, when held in a horizontal firing direction the normal shooting position. "Forward" indicates in the direction of firing.

Referring now to the drawings, a grenade launcher assembly 100 includes an upper rail housing 110, a lower rail housing 112, a trigger assembly 114, a barrel assembly 116, and a pivot assembly 118.

The lower rail housing 112 defines a chassis for supporting the components of a grenade launcher system and in certain embodiment forms a lower portion of a firearm handguard or accessory rail housing which surrounds a barrel 122 of a firearm 120. In the illustrated embodiment, the lower rail housing 112 engages the upper rail housing 110 via axially-extending, interlocking joints 126, such as tongue-and-groove type joints or similar joints having keyed cross-sectional geometry. The joints 126 may be continuously interlocking along the axial length of the rail housing, or maybe segmented along the axial length of the rail housing.

The present system may be used with any standard assault rifle 120, including without limitation an M4, AR15, or M16 rifle or carbine or the like. In certain embodiments, the firearm 120 is a Heckler & Koch 416.

The trigger assembly or firing mechanism 114 is removably attached to a proximal end of the lower rail housing 112. The barrel assembly 116 is positioned forward of the trigger assembly 114. The trigger assembly 114 includes a trigger 113, a firing pin 115, and an associated linkage, e.g., a mechanical, electronic, or electro-mechanical linkage (not shown) therebetween as would be understood by persons skilled in the art. The trigger assembly 114 may further include a manual safety mechanism including a lever 117 movable between a safe position, wherein firing of the weapon is prevented, and a firing position.

The barrel assembly 116 runs below the lower rail housing and is pivotally attached to the lower rail housing at or near the distal or muzzle end thereof to allow the operator to load another round from the breech end of the barrel.

The upper rail housing 110 may be configured as a replacement for an upper hand guard of the firearm 120 and includes an upper accessory rail 128, which may be a Picatinny rail (MIL-STD-1913, STANAG-2324) or other tactical rail. In the illustrated embodiment, the upper rail housing and the lower rail housing are secured about the barrel 122, e.g., via a clamping attachment to the barrel or a component adjacent the barrel, such as the receiver, barrel nut, or the like. Clearance may be provided between the barrel and the upper and lower rail housing members for the gas block 130, gas tube, etc. A throw lever assembly includes a lever 132 pivotally attached to a drawbar 134 about a pivot pin 136, the lever 132 having cam surfaces 138 at the proximal end of the lever, wherein the pivot pin defines an eccentric pivot axis, the lever being pivotable to selectively attach and release the rail housing to the firearm.

The trigger assembly 114 and grenade launcher barrel assembly 116 may be configured for any desired grenade caliber or type. The illustrated embodiment illustrates a barrel assembly 116 for 40 mm grenades. Other grenade calibers and types include 25 mm grenades, 25 mm airburst grenades, smart grenades, and so forth.

The barrel assembly 116 includes a barrel 140 defining a bore which may have rifling 142 on internal surface thereof to impart axial spin to a projectile fired therefrom. A handgrip 144 extends around the bottom and sides of the barrel.

A mounting surface 146 is disposed on the upper surface of the barrel assembly. A protrusion 148 is disposed at a 1st axial position along the barrel assembly. An upstanding pin 150 has an enlarged diameter head 152 is disposed at a 2nd axial position along the barrel assembly. The pin 150 has a generally T-shaped cross sectional shape when taken along its center.

A cavity or recess 154 defining a latch keeper as will be described in greater detail below is disposed at a 3rd axial position along the barrel assembly. An upstanding interface post 156 extends from a left/right tensioner interface plate 157 defining a portion of the surface 146. The interface post 156 is disposed at a 4th axial position along the barrel assembly.

Figure 9:
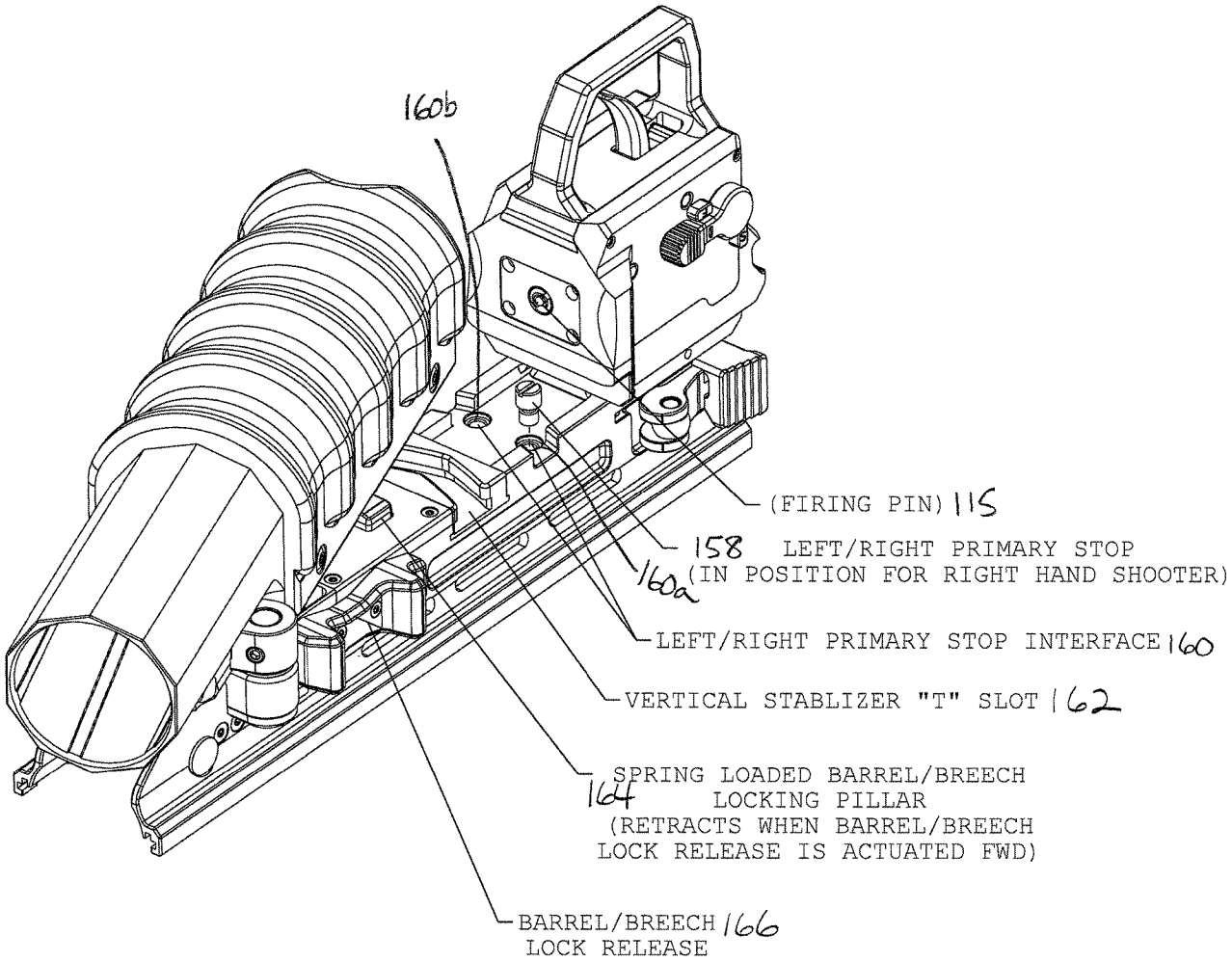
FIG. 9 is an isometric view of the grenade launcher system appearing in FIG. 2 taken generally from the bottom, front, and left side with the barrel assembly in the open position illustrating the configuration for a right-handed shooter.
Figure 10:
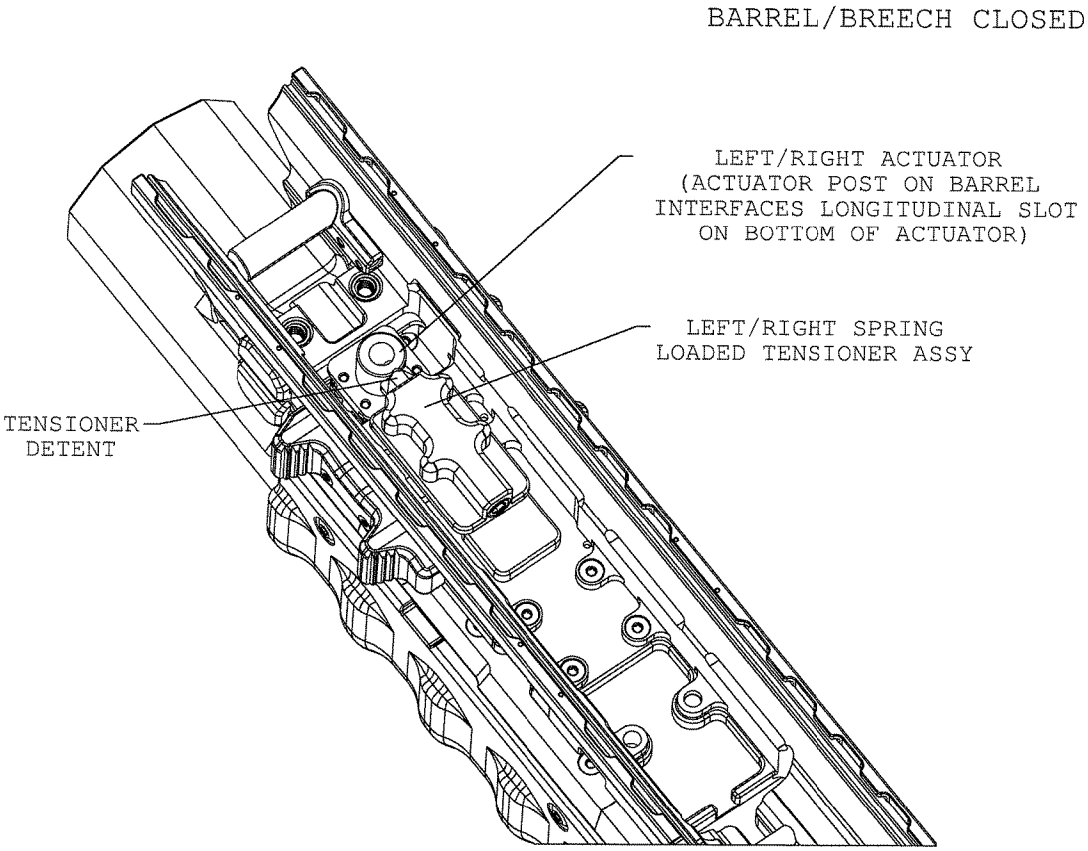
FIG. 10 is an isometric view of the grenade launcher system as it appears in FIG. 3, taken generally from above and the left side.
Figure 11:
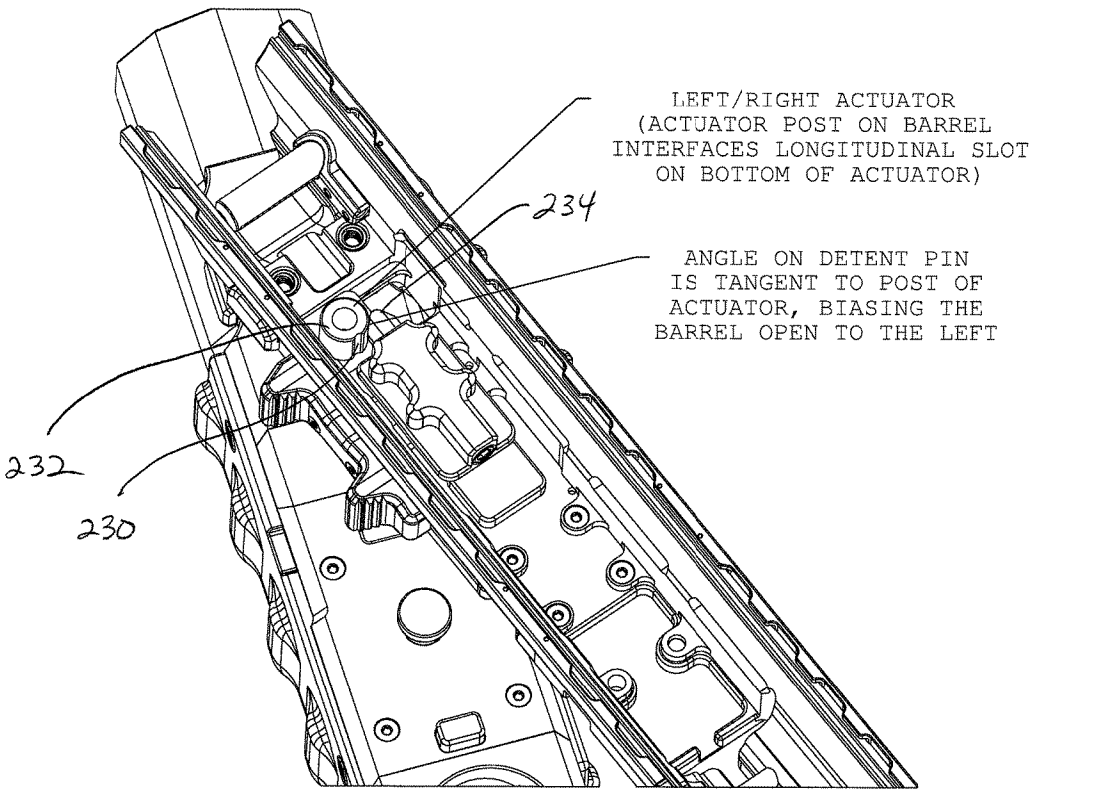
FIG. 11 is an isometric view of the grenade launcher system as it appears in FIG. 3, taken generally from above with the barrel in the open position as configured for a right-handed shooter.
Figure 12:
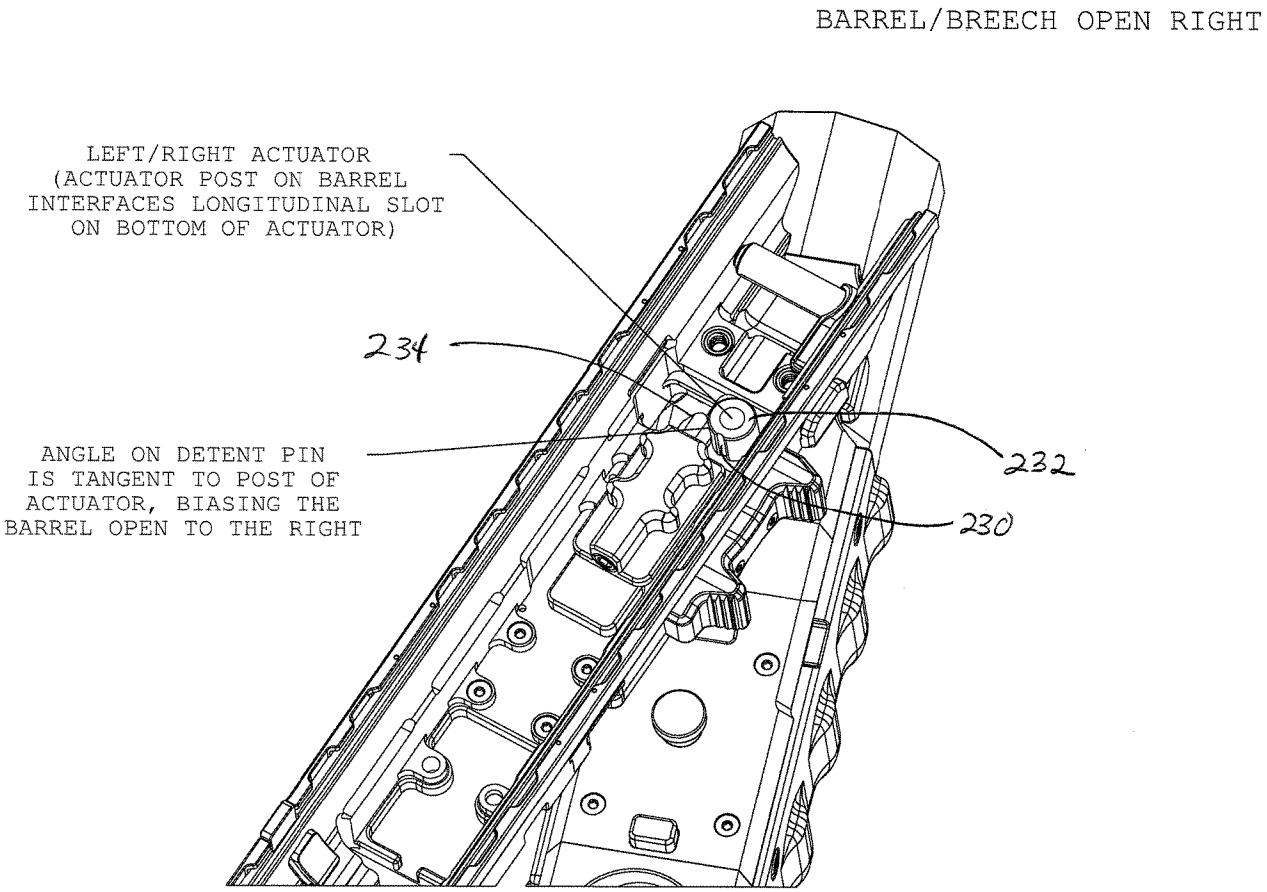
FIG. 12 is an isometric view of the grenade launcher system as it appears in FIG. 7 taken generally from above with the barrel in the open position as configured for a left-handed shooter.
Figure 13:
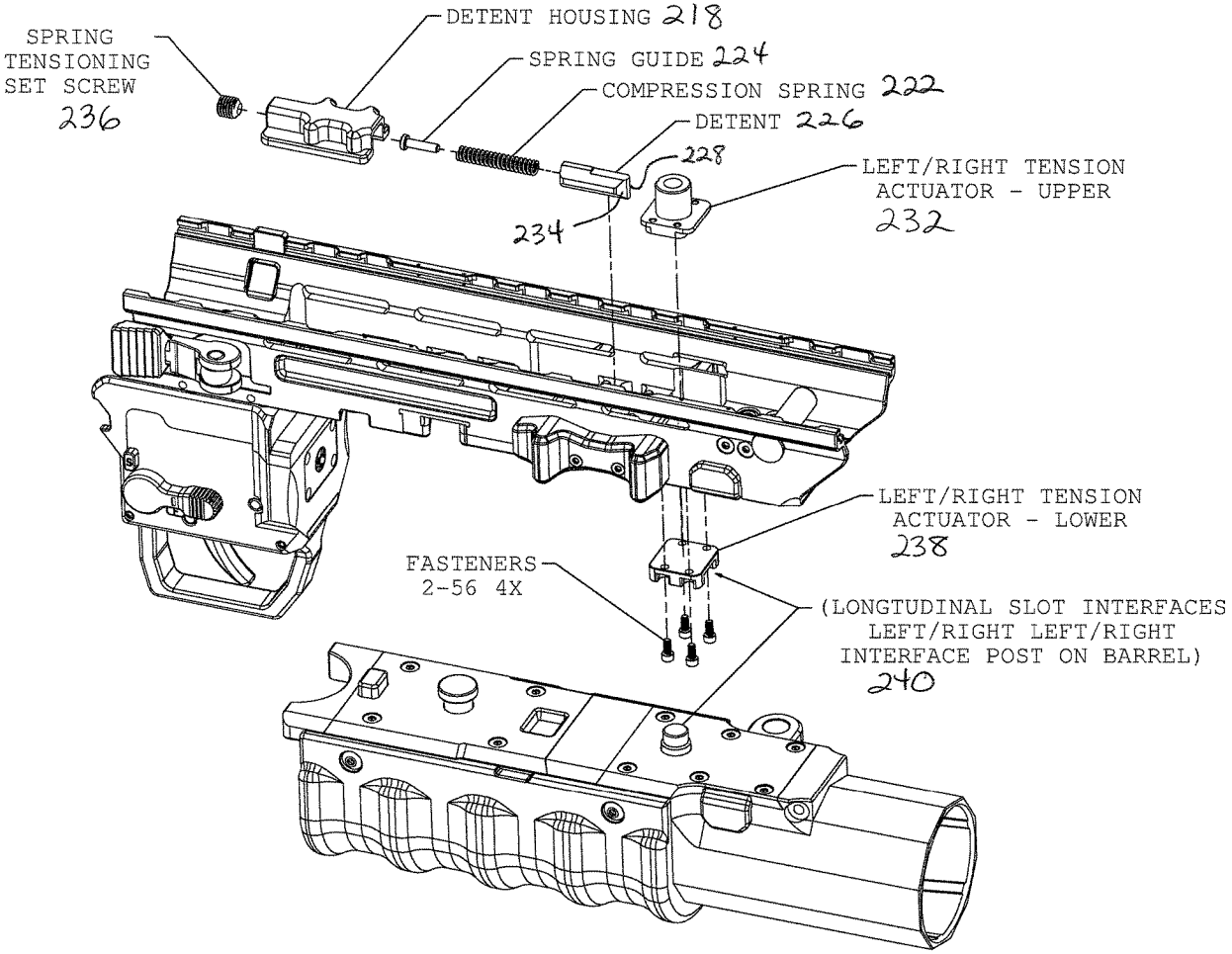
FIG. 13 is a partially exploded isometric view of the grenade launcher system herein illustrating the spring assisted opening mechanism.

As best seen in FIG. 9, a threaded member 158 defining a primary stop is selectively and removably attachable to a desired one of the complementary threaded openings 160*a* and 160*b*. The openings 160*a* and 160*b* are disposed at a 1st axial position along the lower rail housing 112 which is aligned with the 1st axial position on the barrel assembly. When the threaded member 158 is received within the opening 160*a*, the threaded member 158 cooperates with the protrusion 148 which acts as a stop to allow pivoting movement of the barrel assembly 116 about the pivot assembly 118 to the left side only. When the threaded member 158 is received within the opening 160*b*, the threaded member 158 cooperates with the protrusion 148 to allow pivoting movement of the barrel assembly 116 about the pivot assembly 118 to the right side only.

An arcuate slot 162 extends generally transversely across the lower surface of the lower housing at a 2nd position along the lower rail housing 112 which is aligned with the 2nd axial position on the barrel assembly. The slot 162 has a generally T shaped cross-sectional shape and is complementary with the upstanding pin 150. The pin 150 runs in the slot 162 to provide vertical stability to the end of the barrel assembly that is distal to the pivot assembly 118.

A spring loaded barrel/breach locking pillar 164 is disposed at a 3rd axial position along the lower rail housing which is aligned with the 3rd axial position of the barrel assembly. The locking pillar 164 is removably received within the recess 154 to secure the barrel assembly 116 in axial alignment with the lower housing rail. A barrel/breach lock release actuator 166 is slidably carried on the lower housing rail. The lock release actuator 166 is manually movable in the axial direction to release the barrel assembly from the locked position to allow pivoting movement thereof, as will be disclosed in greater detail below. In the locked position, the locking pillar 164 extends into the recess 154 to prevent pivoting movement of the barrel assembly relative to the lower rail housing about the pivot assembly 118. In the unlocked position, the locking pillar 164 is retracted from the recess 154 to allow pivoting movement of the barrel assembly relative to the lower rail housing about the pivot assembly 118.

The pivot assembly 118 includes an lower pivot bar 168, a upper pivot bar 170, and a pivot pin 172. The lower pivot bar 168 includes a lower, downward extending barrel 174 and a downward extending wall 176 on opposite ends of a transverse portion 178 generally defining an inverted U-shape. The upper pivot bar 170 includes an upper, upstanding barrel 180 and an upstanding wall 182 on opposite ends of a transverse portion 184 generally defining a U-shape.

The pivot pin 172 extends vertically and defines a pivot axis 186 of the pivot assembly 118. The pivot pin 172 extends through a vertical opening 188 in the lower barrel 174 and an aligned vertical opening 190 in the upper barrel 180. A washer 192 is received about the pin 172 and is disposed between the upper and lower barrels.

A threaded cross pin 194 extends through a horizontal (i.e., perpendicular to the pivot axis 186) opening 196 in the lower barrel and engages a complementary threaded opening 198 in the pin 172 to removably secure the lower end of the pin 172 within the lower barrel 174. In certain embodiments, the threaded cross pin 194 is replaced with a quick release cross pin, such as a quick release pin with a spring biased plunger mechanism, such as a ball detent mechanism.

A pivot cap 200 is positioned on an upper surface of the upper barrel 180. A threaded fastener 202 passes through an opening 204 in the cap 200 and engages a threaded opening 206 along the pivot pin axis 186 to removably and rotatably engage the upper end of the pin 172 within the upper barrel 180.

The lower pivot bar 168 is sandwiched between the barrel and the tensioner interface plate 157, such that the transverse portion 178 is received within a transverse channel defined by axially aligned transverse slots 208, 210 formed on the facing surfaces of the barrel and the interface plate 157, respectively. The interface plate 157 is removably secured to the barrel via a plurality of threaded fasteners 212.

The transverse portion 184 of the upper pivot bar 170 is received within a transverse channel 214 defined on the lower surface of the lower rail housing as a position which is aligned with the axial position of the lower pivot bar 168. The upper pivot bar 170 is removably secured to the lower rail housing via threaded fasteners 216.

Figure 5:
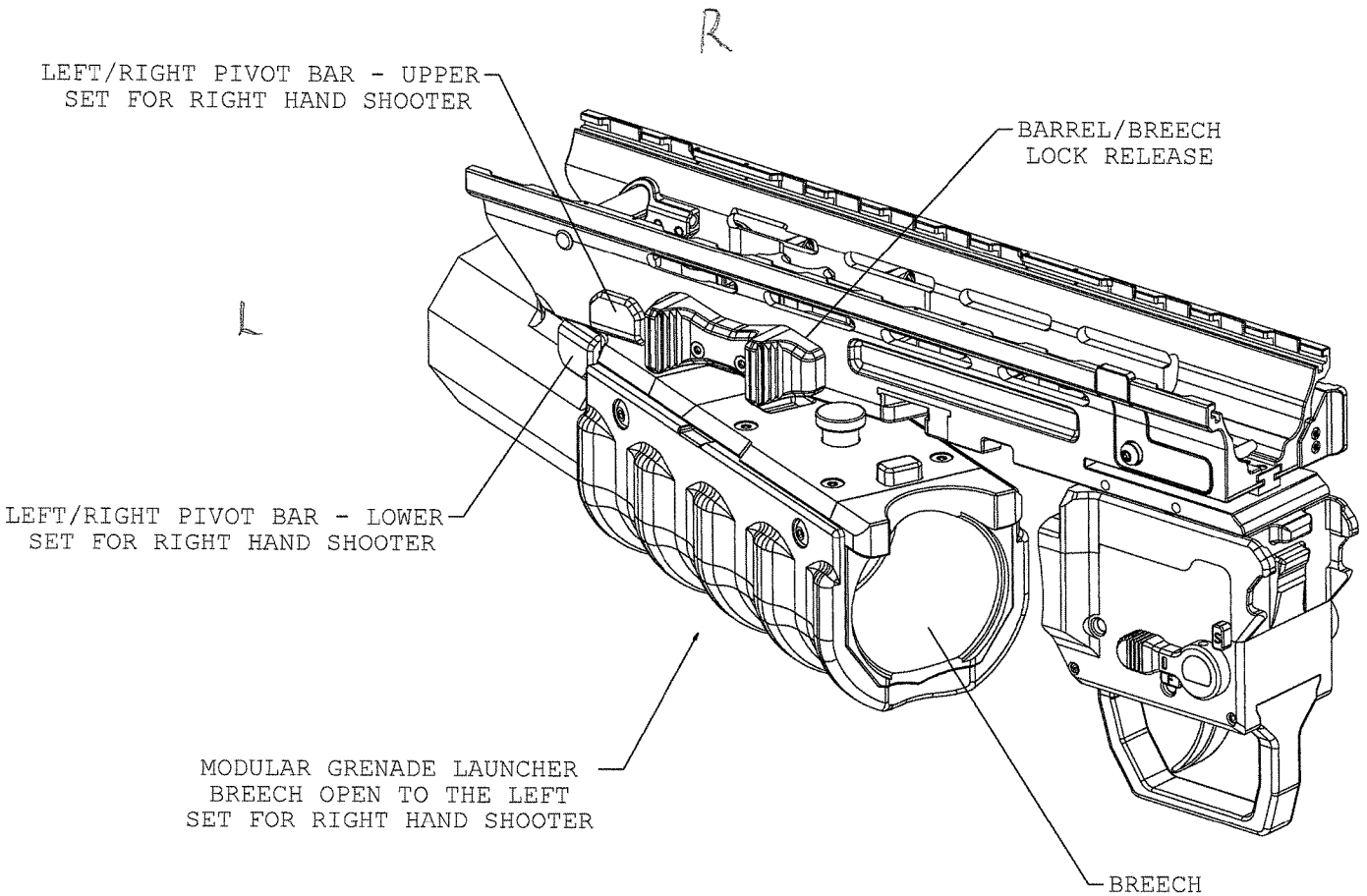
FIG. 5 is an isometric view of the grenade launcher system appearing in FIG. 2 taken generally from the rear and left side with the barrel assembly in the open position illustrating the configuration for a right-handed shooter.
Figure 6:
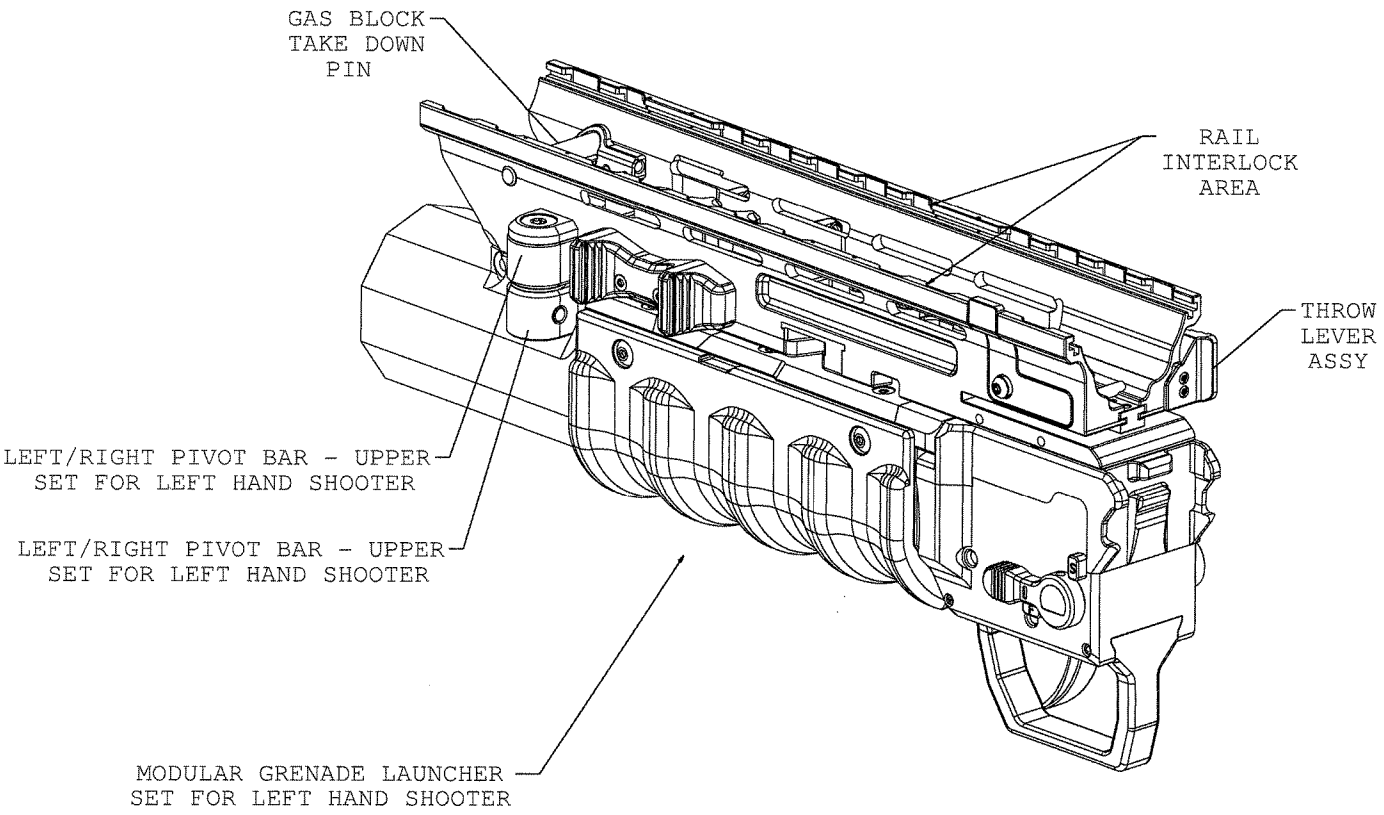
FIG. 6 is an isometric view of the grenade launcher system taken generally from the rear and left side with the barrel assembly in the closed position illustrating the configuration for a left-handed shooter.

When it is desired to configure the grenade launcher assembly for a right handed shooter, the lower pivot bar 168 and upper pivot bar 170 are positioned such that the respective lower and upper barrels are disposed on the right side of the barrel assembly. In addition, the primary stop 158 is positioned in the right sided opening 160*a*. In the right-handed configuration, actuating the barrel/breech lock release causes the barrel assembly to pivot to the left side of the firearm as shown in FIG. 5.

Figure 7:
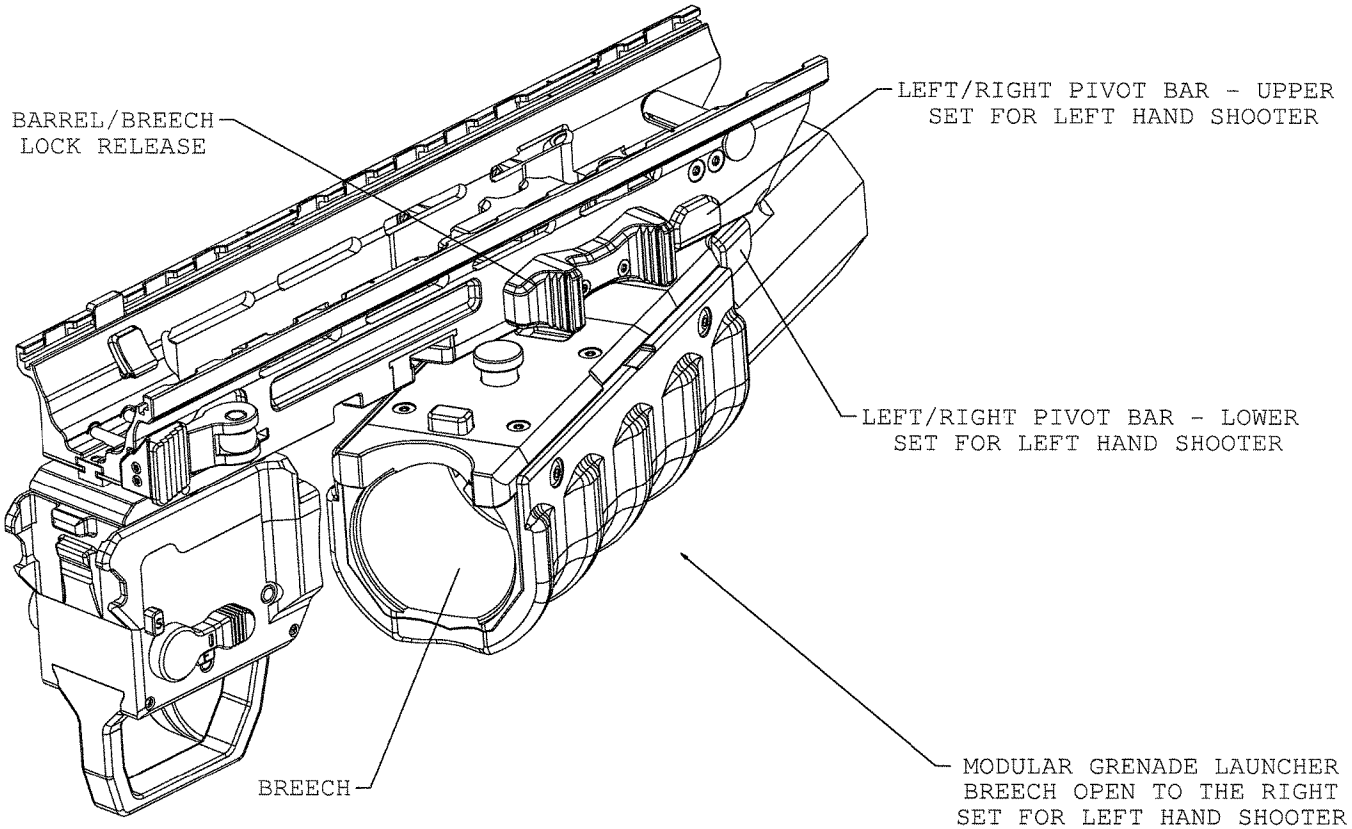
FIG. 7 is an is an isometric view of the grenade launcher system taken generally from the rear and right side with the barrel assembly in the open position illustrating the configuration for a left-handed shooter.
Figure 8:
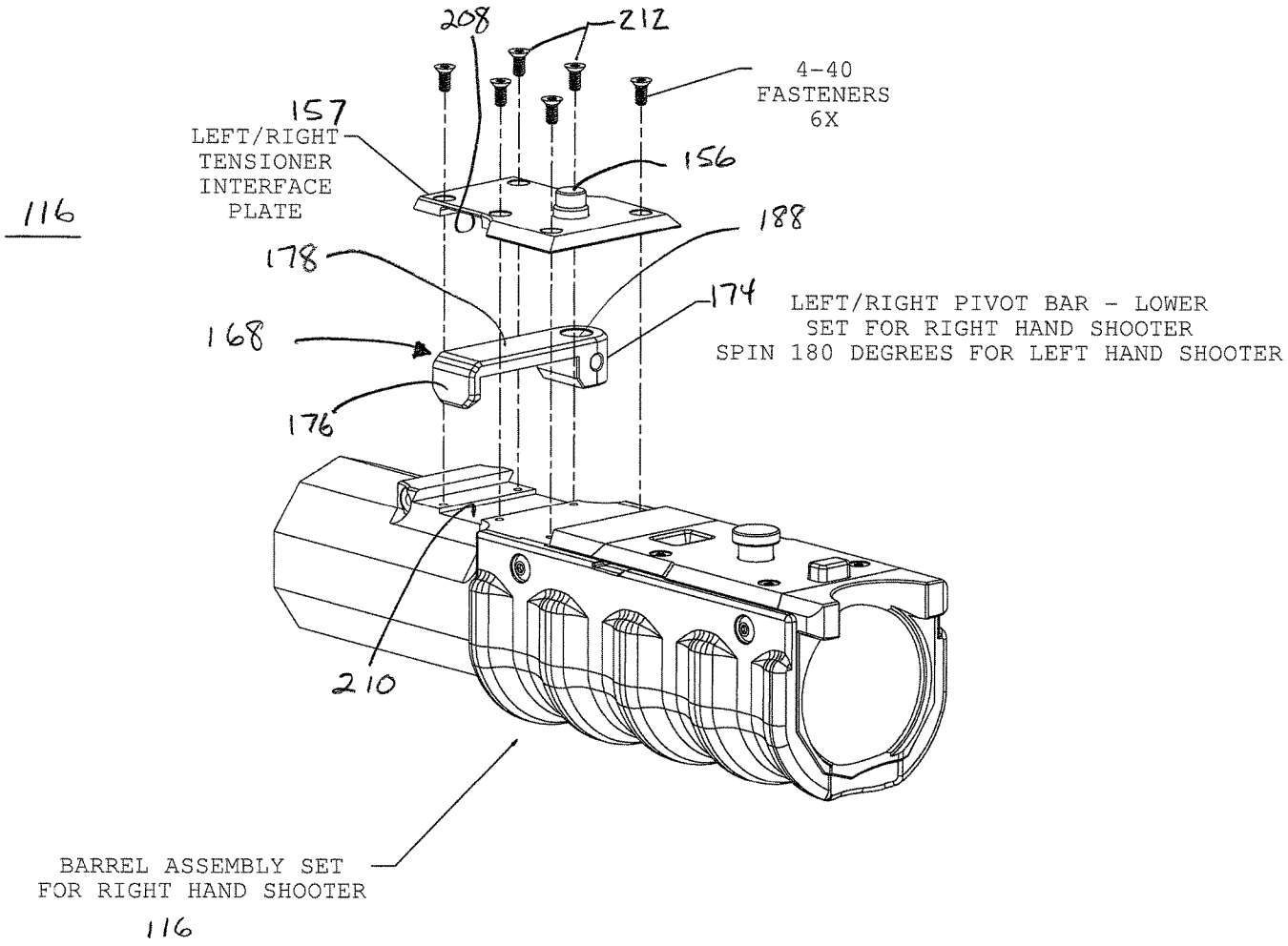
FIG. 8 is an isometric, partially exploded view of the barrel assembly.

When it is desired to configure the grenade launcher assembly for a left handed shooter, the lower pivot bar 168 and upper pivot bar 170 are positioned such that the respective lower and upper barrels are disposed on the left side of the barrel assembly. In addition, the primary stop 158 is positioned in the left sided opening 160*b*. In the left-handed configuration, actuating the barrel/breech lock release causes the barrel assembly to pivot to the right side of the firearm as shown in FIG. 7.

To change the configuration from a right-handed configuration to a left-handed configuration, or vice versa, the barrel is released using the lock release 166 and the threaded fastener 202 is removed to separate the barrel assembly from the lower rail housing. The upper pivot bar 170 is removed by removing the threaded fasteners 216. The lower pivot bar 168 is removed from the barrel assembly by removing the fasteners 212 and the interface plate 157. The upper and lower pivot bars 170, 168 are then rotated 180° in the horizontal plane and then reattached to the lower rail housing and barrel assembly, respectively, as described above. In addition, the primary stop 158 is moved from the right opening 160*a* to the left opening 160*b*, or vice versa.

As best seen in FIGS. 10 through 13 (and with continued reference to FIGS. 1 through 9) a left/right actuator assembly is disposed within the interior of the lower rail housing, i.e., between the floor of the lower rail housing and the barrel of an associated firearm. The left/right actuator assembly includes a detent housing 218 having an axial channel 220 defined therein. An axial compression spring 222, coaxial spring guide 224, and axially movable detent or plunger 226 are received within the axial channel 220. The spring 222 urges a tip 228 of the plunger or detent 226 into vertical groove 230 on the surface of an upper left/right tension actuator 232 when the barrel assembly and lower housing rail are in the aligned, operable position. When the barrel assembly is pivoted to the open position, the tip of the plunger is moved out of engagement with the upper tension actuator, and the spring urges the plunger in the forward direction. The angled or tapered side surfaces 234 are generally tangent to the cylindrical wall of the upper tension actuator to create a biasing force urging the barrel to open to the left (see FIG. 11) or right (see FIG. 12), depending on the orientation of the pivot assembly 118. A spring tensioning setscrew 236 is received within a threaded opening in the detent housing and can be axially advanced or retracted to adjust or fine-tune the biasing force.

The left/right actuator assembly also includes a lower left right tension actuator 238 which includes a longitudinal slot 240 which interfaces with the interface post 156 on the barrel assembly.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A grenade launcher comprising a chassis, a barrel assembly comprising a barrel mounted on the chassis, the barrel having a breech end and a muzzle end, and a pivot mechanism, the pivot mechanism comprising:

a first pivot bar on the barrel assembly and extending transversely with respect to a longitudinal axis of the barrel and having a first hinge barrel disposed at one transverse end thereof, the first pivot bar being attachable in a first orientation wherein the first hinge barrel is on a left side of the barrel assembly and a second orientation wherein the first hinge barrel is on a right side of the barrel assembly;

a second pivot bar on the chassis aligned with and facing the first pivot bar, the second pivot bar having a second hinge barrel disposed at one transverse end thereof, the second pivot bar being attachable in a first orientation wherein the second hinge barrel is on a left side of the barrel assembly and a second orientation wherein the second hinge barrel is on a right side of the barrel assembly; and a pivot pin extending in a first vertical opening in the first hinge barrel and in a second vertical opening in the second hinge barrel, the pivot pin defining a pivot axis for pivoting movement of the barrel assembly, relative to the chassis, between a closed position and a selected one of a left open position and a right open position.

2. The grenade launcher of claim 1, wherein the barrel assembly is configured to pivot to the left open position when the first and second hinge barrels are disposed on the right side of the barrel assembly and the barrel assembly is configured to pivot to the right open position when the first and second hinge barrels are disposed on the left side of the barrel assembly.

3. The grenade launcher of claim 1, further comprising:

a locking pillar disposed on the chassis and removably received within a complementary recess in the barrel assembly for securing the barrel assembly in the closed position.

4. The grenade launcher of claim 3, further comprising:

a lock release actuator carried on the chassis and movable to retract the locking pillar from the recess to allow pivoting movement of the barrel assembly to the open position.

5. The grenade launcher of claim 4, further comprising:

a spring biased plunger on the chassis engaging a tension actuator for creating a biasing force urging the barrel assembly to pivot to a selected one of the left open position and the right open position responsive to movement of the lock release actuator.

6. The grenade launcher of claim 5, wherein the tension actuator has a generally cylindrical wall and the spring-biased plunger has angled side surfaces which are generally tangent to the generally cylindrical wall.

7. The grenade launcher of claim 6, wherein the tension actuator has a vertical groove formed in the generally cylindrical wall and wherein the spring biased plunger engages the vertical groove when the barrel assembly in the closed position.

8. The grenade launcher of claim 3, wherein the locking pillar is a spring biased locking pillar.

9. The grenade launcher of claim 1, further comprising:

a stabilizer pin on the barrel assembly received within a complimentary slot in the chassis.

10. The grenade launcher of claim 1, further comprising:

a stop member selectively positionable at a first stop position on the chassis and a second stop position on the chassis, the barrel assembly movable to the left open position when the stop member is in the first stop position and the right open position when the stop member is in the second stop position.

11. The grenade launcher of claim 1, wherein said second pivot bar is disposed within a transverse slot in the barrel assembly.

12. The grenade launcher of claim 11, wherein the transverse slot is defined between the barrel and an interface place, wherein said interface place is removably attached to the grenade launcher barrel with one or more mechanical fasteners.

13. The grenade launcher of claim 1, wherein the lower chassis portion includes a transverse channel configured to receive the first pivot bar.

14. The grenade launcher of claim 1, wherein the chassis is configured for removable attachment to a rifle.

15. The grenade launcher of claim 1, wherein the chassis includes one or more firearm accessory rails.

16. The grenade launcher of claim 1, further comprising:

a trigger assembly removably attached to the chassis at a position adjacent the breech end of the barrel.

17. The grenade launcher of claim 1, which is configured for standalone operation.

18. A pivot mechanism for a grenade launcher of a type having a chassis and a barrel assembly mounted on the chassis, the barrel assembly including a barrel having a breech end and a muzzle end, the pivot mechanism comprising:

a first pivot bar on the barrel assembly and extending transversely with respect to a longitudinal axis of the barrel and having a first hinge barrel disposed at one transverse end thereof, the first pivot bar being attachable in a first orientation wherein the first hinge barrel is on a left side of the barrel assembly and a second orientation wherein the first hinge barrel is on a right side of the barrel assembly;

a second pivot bar on the chassis aligned with and facing the first pivot bar, the second pivot bar having a second hinge barrel disposed at one transverse end thereof, the second pivot bar being attachable in a first orientation wherein the second hinge barrel is on a left side of the barrel assembly and a second orientation wherein the second hinge barrel is on a right side of the barrel assembly; and a pivot pin extending in a first vertical opening in the first hinge barrel and in a second vertical opening in the second hinge barrel, the pivot pin defining a pivot axis for pivoting movement of the barrel assembly, relative to the chassis, between a closed position a selected one of a left open position and a right open position.

* * * * *